US008245719B2

(12) United States Patent
Kirby

(10) Patent No.: US 8,245,719 B2
(45) Date of Patent: Aug. 21, 2012

(54) WALKER WITH REMOVABLE COMBINED UTILITY TRAY AND SEAT

(76) Inventor: Avery Kirby, Block Island, RI (US)

( * ) Notice: Subject to any disclaimer, the term of this patent is extended or adjusted under 35 U.S.C. 154(b) by 20 days.

(21) Appl. No.: 12/807,795

(22) Filed: Sep. 15, 2010

(65) Prior Publication Data

US 2012/0060877 A1 Mar. 15, 2012

(51) Int. Cl.
*A45B 5/00* (2006.01)

(52) U.S. Cl. ..... 135/66; 135/67

(58) Field of Classification Search ..... 135/66, 135/67
See application file for complete search history.

(56) References Cited

U.S. PATENT DOCUMENTS

| | | | | |
|---|---|---|---|---|
| 3,232,251 | A * | 2/1966 | Hughes | 108/50.16 |
| 4,643,211 | A | 2/1987 | Morris et al. | 135/67 |
| 4,659,099 | A * | 4/1987 | Malone | 280/304.1 |
| 4,708,274 | A * | 11/1987 | Roche | 224/407 |
| 4,850,641 | A | 7/1989 | Walker | 297/6 |
| 4,907,839 | A | 3/1990 | Rose et al. | 297/6 |
| 5,133,377 | A * | 7/1992 | Truxillo | 135/67 |
| 5,217,032 | A * | 6/1993 | Jobst | 135/67 |
| 5,353,824 | A | 10/1994 | Woods et al. | 135/66 |
| 5,716,063 | A * | 2/1998 | Doyle et al. | 280/87.05 |
| 6,311,708 | B1 | 11/2001 | Howle | 135/67 |
| 6,371,142 | B1 | 4/2002 | Battiston | 135/67 |
| 6,817,372 | B2 * | 11/2004 | Ennals et al. | 135/66 |
| 6,883,529 | B2 * | 4/2005 | Kvaternik | 135/66 |
| 6,948,727 | B1 | 9/2005 | Bakken | 280/87.021 |
| 7,021,324 | B1 * | 4/2006 | Clay et al. | 135/67 |
| D567,151 | S | 4/2008 | Owens | D12/130 |
| 2006/0011228 | A1 * | 1/2006 | Craig | 135/67 |
| 2008/0007020 | A1 * | 1/2008 | Holman | 280/87.051 |
| 2008/0141911 | A1 * | 6/2008 | McKenna | 108/50.16 |
| 2009/0120479 | A1 * | 5/2009 | McCarthy | 135/66 |

FOREIGN PATENT DOCUMENTS

| | | |
|---|---|---|
| CA | 1247513 | 12/1988 |
| CN | 2815339 | 9/2006 |

OTHER PUBLICATIONS

Invacare Product Catalog, Sep. 21, 2010, Dual-Release Walker with 5' Fixed Wheels, 3 pages.
Invacare Product Catalog, Sep. 21, 2010, Walker Tray for 6240, 1 p.

* cited by examiner

*Primary Examiner* — Noah Chandler Hawk
(74) *Attorney, Agent, or Firm* — Peter Saxon

(57) ABSTRACT

A walker with a tubular frame assembly has a pair of inverted U-shaped frame members each having a pair of legs. A front cross bar is attached to the frame members to maintain them in an upright position. A pair of side braces extend between the legs of the frame members. A combined tray-seat in a drawer shape is detachably mounted on the side braces. The side members of the tray-seat extend at least to the frame and side braces. Self-adhering strips on the front crossbar and tray-seat support the tray-seat vertically when the walker is moved. The tray-seat may have a hole in its front end and a broom clip on its rear end to support a cane. The hole also acts as a drain. A perforated platform on the combined tray-seat acts as a beverage holder.

1 Claim, 5 Drawing Sheets

WALKER WITH REMOVABLE COMBINED UTILITY TRAY AND SEAT

BACKGROUND OF THE INVENTION

Typically, walkers are used by the elderly or invalid persons to assist in the ambulation process, that is, to enable such person to be able to walk certain distances on their own. Such walkers are quite common and, in general, most commonly have a pair of side frames, generally configured as A-shape or inverted U-shape and which are joined together with one or more cross-members so that the walker is sufficiently strong to support the person. The side frames include legs that extend downwardly to contact the ground for support of the walker as the person ambulates.

Thus the upper portion of the side frames is a horizontal section that can be gripped by the user so that the walker can be used for the support as well as progressed forwardly by the user at each step. Preferably the overall unit can be formed of a tubular metal, such as aluminum, and the various components welded together to provide the necessary strength.

One of the features of some of the current walkers is the addition of a seat that can be moved into a horizontal position by the user so that the user can, as desired, sit down to rest or as needed in the event of a medical need. It is obviously important that the seat be readily available to the user when needed and yet be fully out of the way when the user is utilizing the walker to move from one location to another.

Most such seats require substantial dexterity in moving the seat out of the way when changing locations and in moving the seat from a stored vertical position to a horizontal position. This can be difficult for a person with limited dexterity. Such a walker is shown in U.S. Pat. No. 7,940,637.

In addition, in the construction of seated walkers, there is generally a side brace that joins the two legs of each of the side frames. The side brace is important to provide the structural strength and integrity of the overall walker and, accordingly, it was deemed preferable to the structural integrity that the side brace be located at a lowered position joining the legs; that is, that the side brace be relatively close to the ground that is contacted by the legs when utilizing the walker.

The braces, however, are also a convenient structural component to use as support for the seat when it is pivoted to its lower, horizontal position. Therefore, there is an unresolved conflict in the construction of such walkers. It is clearly advantageous for the seat to be supported by the side braces, but the design goal of positioning the side braces to be as low as possible would normally result in the seat being too low to be comfortable and convenient for the user. A low positioned seat, obviously, makes it difficult for the user to be able to sit and arise without difficulty. Thus, it would be advantageous to be able to construct a walker where the side braces are sufficient so as to optimize structural integrity and strength of the walker, and yet to allow the seat, when in its horizontal position, to be oriented at a sufficient height so that the user can comfortably sit and stand without difficulty.

It is also highly advantageous to provide a walker with a utility tray for carrying books and beverages, such as water bottles, soda cans and the like as well as canes and umbrellas, which can be easily mounted and removed from the walker when changing locations. In order to maximize the flexibility of the walker it is desirable to provide a readily mountable-demountable combined seat and utility tray to allow for use by elderly or impaired persons with limited dexterity.

Conventional solutions for providing movable or removable seats and/or tray tables for walkers have been unsatisfactory in various aspects. In U.S. Pat. No. 6,371,142, a hinged seat is employed, but the seat is not readily removable. Similar hinged seats are proposed in US Patent Publication 2005/0121258A1; Canadian Patent 1,247,513 and U.S. Design Pat. 567,151. Foldable seats permanently affixed to the walker-are disclosed in U.S. Pat. Nos. 4,850,641 and 4,907,839 and Chinese Patent 2815339.

A removable utility tray is disclosed in U.S. Pat. No. 7,547,027 which employs armrest platforms which require complex mounts to be permanently affixed to the walker. In U.S. Pat. No. 6,948,727 a tray is coupled to a top edge of a collapsible walker which makes the walker difficult to move when so mounted. Folding walker trays are commercially available, such as the folding INVACARE® Walker Tray. However such trays are not detachable, are not adapted to be used as a seat and are relatively expensive, requiring sophisticated folding mechanisms for repositioning when not in use.

SUMMARY OF THE INVENTION

Accordingly, it is an object of the present invention to provide a removable combined utility tray and seat (hereafter referred to as a "tray-seat") which is readily mounted and removed by impaired persons.

It is another object to provide a readily detachable combined utility tray and seat which is easily moved to a storage position and readily secured against movement to increase maneuverability of the walker.

It is a further object to provide a detachable tray-seat which can readily support a cane.

These and other objects and advantages are realized in a walker comprising: (a) a frame having (i) a pair of inverted U-shaped frame members each having a pair of legs extending downwardly; (ii) a front crossbar affixed to said frame members and disposed therebetween to maintain said frame members in an upright position; and (iii) a pair of side braces, each side brace extending between the legs of each said U-shaped members; and (b) a combined removable tray-seat detachably mounted on said pair of side braces, said combined tray-seat being generally drawer-shaped with a pair of side members, each side member extending at least to the periphery of the frame and at least to the ends of the side brace to brace the tray-seat against movement.

In another embodiment a self-adhering strap is affixed to the front cross bar of the walker and a complementary self-adhering strip is mounted on a front end of the tray-seat to retain the tray-seat in a vertical position when the walker is moved.

In yet another aspect the side braces terminate at each end in a spring clip for mounting the braces to the legs of the U-shaped members at a predetermined position.

In an additional embodiment the front end of the tray-seat has a hole aligned with broom clip mounted on the back end of the tray-seat to support a cane passing through the broom clip and hole and to act as a drain for liquids collected in the tray-seat.

In another preferred embodiment a perforated platform is affixed over a corner of the tray-seat to accommodate a beverage.

Other features and advantages will become apparent from the following detailed description with reference to the following illustrative drawings.

DETAILED DESCRIPTION OF THE INVENTION

Figure 1:
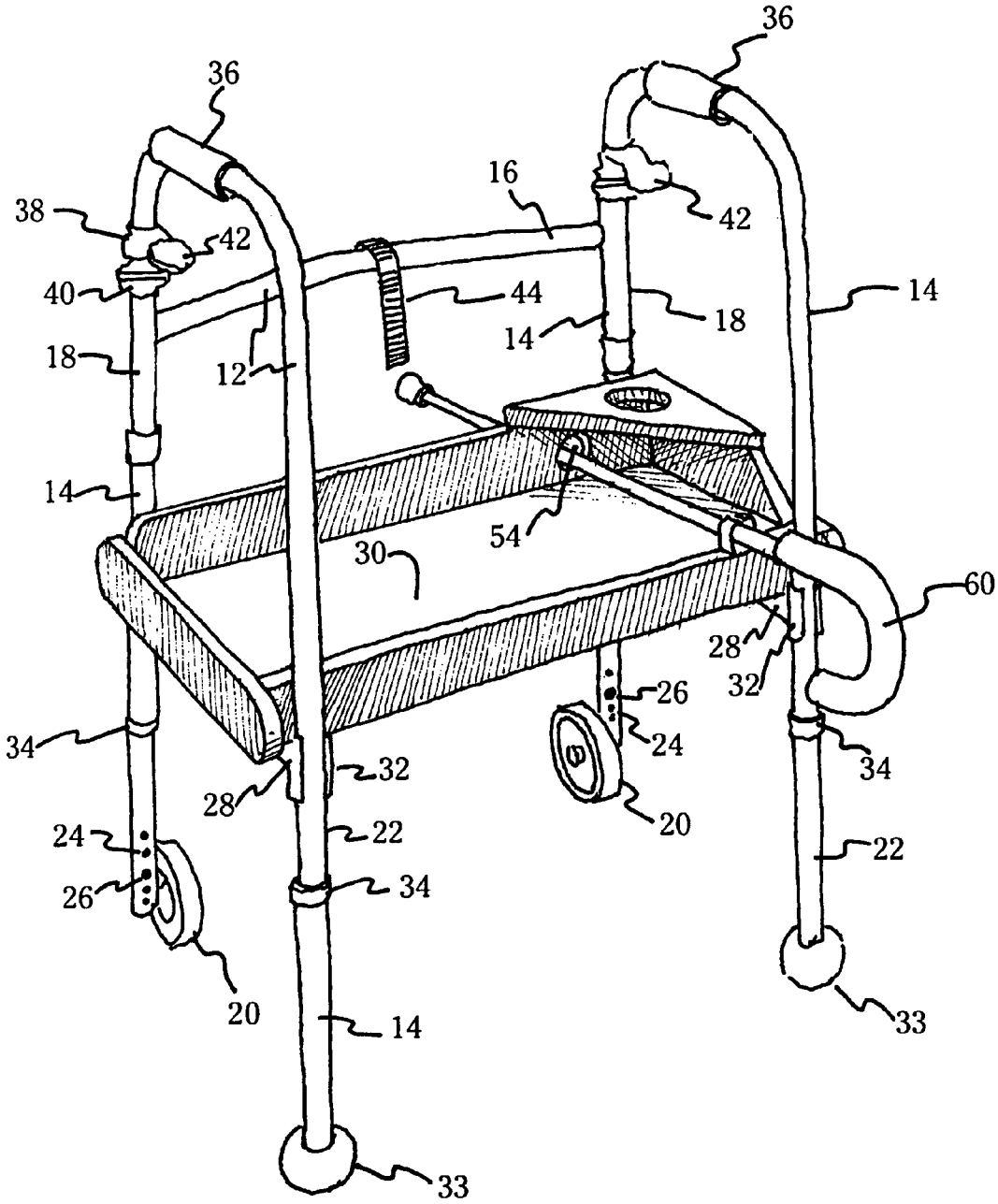
FIG. 1 is a perspective view of a walker in accordance with the present invention.

Referring now to FIG. 1 there is shown a perspective view of a walker 10 constructed in accordance with the present invention. The walker 10 includes a frame 12 comprising a pair of inverted U-shaped frame members 14 that are spaced apart to provide room for the user to stand when utilizing the apparatus and at least one crossbar 16 to maintain the frame members in an upright position. As employed herein, the front of the walker is the direction in which the user is ambulating when using the walker 10. Thus, in FIG. 1, the U-shaped frame members 14 are shaped so as to include front legs 18 that may have wheels 20 to facilitate movement of walker 10 by the user and rear legs 22. The rear legs terminate in a cushioned stop 33 which may be a tennis ball or the like. Both the front legs 18 and the rear legs 22 may be adjustable for height to suit the individual user. Such adjustable height means may be a plurality of holes 24 where a spring-loaded button 26 can emerge to lock the legs into the desired height.

Side braces 28 are affixed to the front and rear legs 18, 22 to provide support for the legs and to support removable tray-seat 30. The side braces are positioned sufficiently above the ground to permit the user to easily access the tray-seat 30 and its contents and to be readily seated in the tray-seat. The side braces 28 are affixed to the front and rear legs 18, 22 by clips 32 which can be slid along the legs to adjust the height of the tray-seat to the individual user. A pair of stops 34 are spaced on the front and rear legs 18, 22 of the U-shaped members 14 to prevent the tray-seat from slipping to the ground under excessive load.

At the upper portion of the U-shaped frame members 14 there is a generally horizontal portion which may include a grip 36 that is held by the user to control and use the walker 10.

Rear legs 22 are both movable and are pivotally affixed to front legs 18 so that the rear legs can be rotated from the position shown in FIG. 1 to a collapsed or closed position. A locking mechanism 38 on each front leg 18 allows the rear legs 22 to be rotated in the open position shown in FIG. 1 and to release the rear legs 22 when it is desired to collapse the walker 10. The locking mechanism 38 is conventional and includes an annular catch plate 40 having a lock hole that is engaged by a spring-biased detente 42 as shown in U.S. Pat. No. 7,040,637, the disclosure of which is incorporated herein by reference at least with regard to the wheeled ambulatory support or rollator having at least the U-shaped side frames, front and back legs, crossbar with brackets and locking mechanism.

Figure 3:
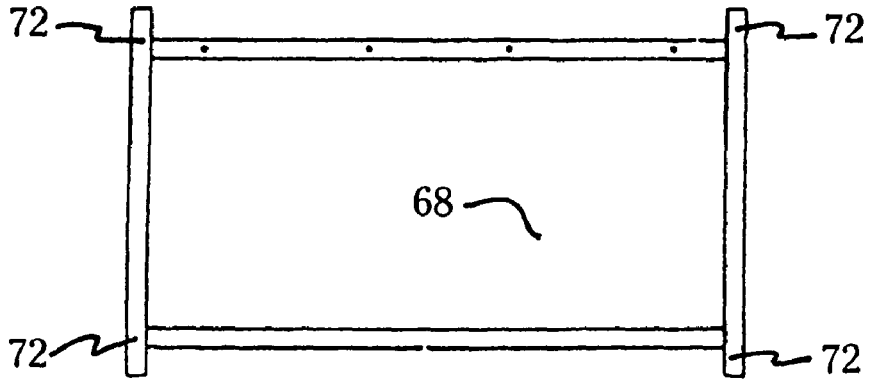
FIG. 3 is a bottom view of the tray-seat.
Figure 5:
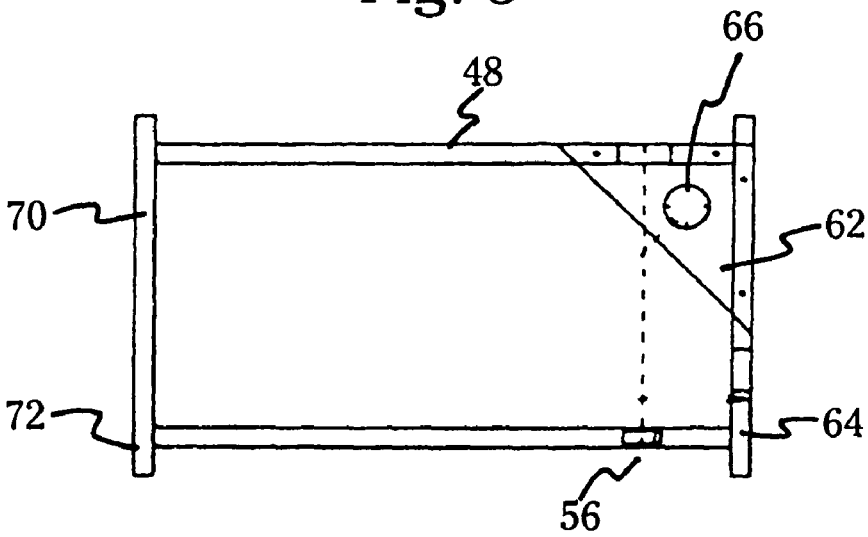
FIG. 5 is a top plan view of the tray-seat.

Preferably, the tray-seat 30 is made of wood, although any strong, durable material which has no sharp edges or rust concerns, such a a strengthened plastic material or a rust-resistant or coated metal, can be employed. The tray may be assembled with nails, screws, bolts, and/or glue and is preferably rectangular in shape. The tray-seat 30 includes a base 68, a front section 48, a rear section 58, a left side section 70 and a right side section 64. As shown in FIGS. 3 and 5, right and left side sections 64, 70 have terminal ends 72 which extend at least to the periphery of the frame 12 which serve to stabilize the tray against movement once it is seated over the side braces 28. The terminal ends 72 can rest adjacent the ends of the clips 32 of side braces 28. For further stability the ends 72 can extend beyond the ends of the clips 32.

Figure 2:
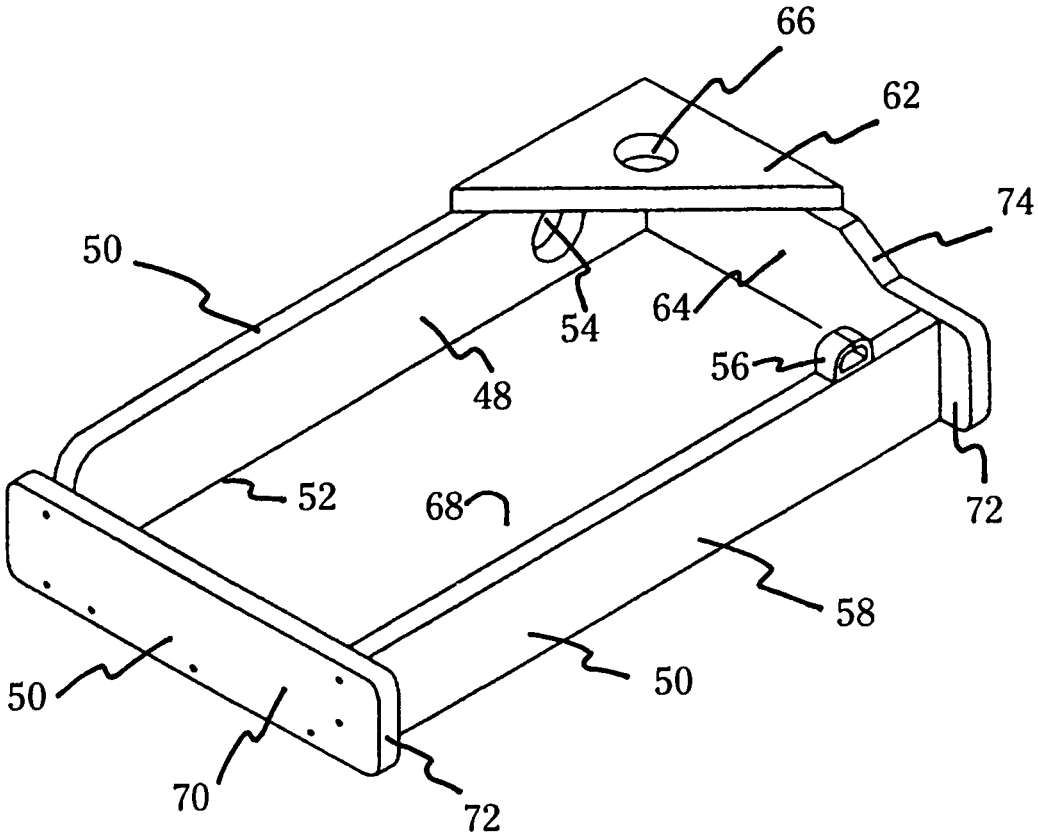
FIG. 2 is a perspective view of the tray-seat of the walker.
Figure 4:
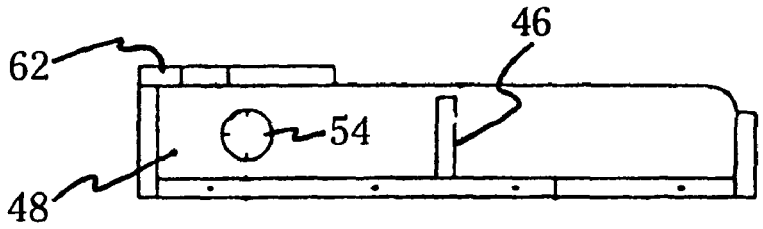
FIG. 4 is a front view of the tray-seat.

The tray-seat 30, as shown in FIG. 1, is detachably seated on side braces 28 of walker 10. The tray-seat 30 provides both a seat for the user and a horizontal utility surface for the user's accessories. The tray-seat is readily . mounted over the side braces 28 to serve as a seat or as a mobile carry-all to hold books, beverages, a water bottle, a cane, an umbrella, sunglasses, a soda can and the like. The tray-seat is designed to be vertically storable on the walker, when not needed. For this purpose a self-adhering strap 44 formed of Velcro® material or the like is attached to cross-bar 16 of walker 10. As shown in FIG. 4 a complementary self-adhering strip 46 made of Velcro® material or the like is adhered to a front section 48 of the tray-seat. The strip on the tray-seat can be removably fastened to the self-adhering strip 44 to secure the tray-seat in an upright position to the walker crossbar 16. As shown in FIGS. 2 and 3, the tray-seat 30 further includes a raised rim 50 adjacent to perimeter edge 52 of tray-seat bottom 68 to inhibit spillage of the contents of the tray onto the ground.

Figure 8:
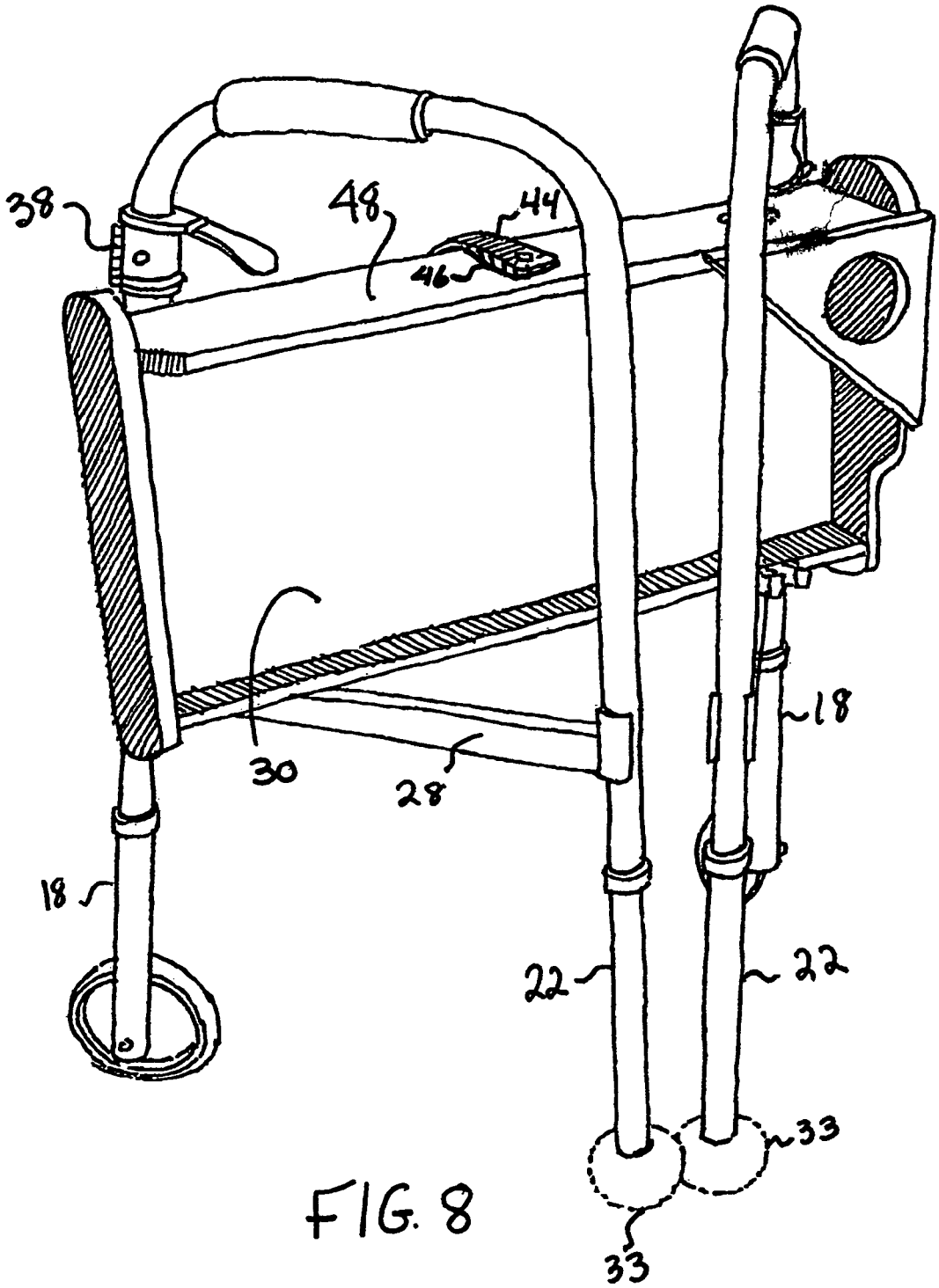
FIG. 8 is a rear view of the tray-seat stored in the walker.

As illustrated in FIG.8 to store tray-seat 30, the tray seat is lifted 90° to a vertical position from its mounted position and self-adhering strip 44 mounted on cross bar 16 is adhered to self-adhering strip 46 (FIG.4) attached to the first section 48 of tray-seat 30. Thereafter, rear legs 22 are pivoted toward each other, until cushioned stops 33 meet at a collapsed or closed position, by releasing locking mechanism 38. The tray-seat 30 is supported by strap 44 attached to strip 46, by front legs 18 and by side braces 28 as shown in FIG. 8. Strap 44 is adhered over strip 46 to allow positive attachment and easy separation by a disabled person.

Figure 6:
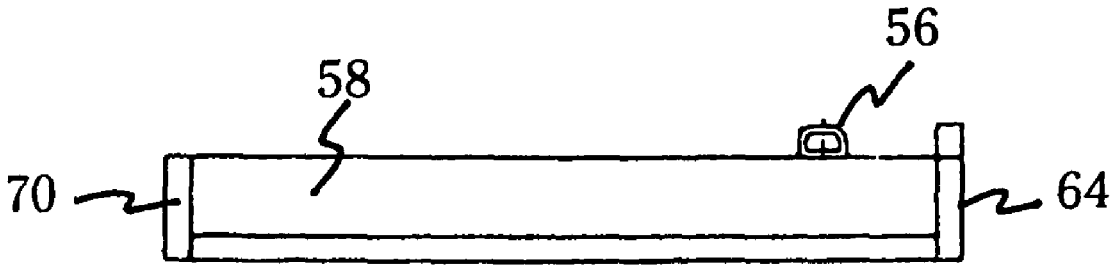
FIG. 6 is a rear view of the tray-seat.

The tray also includes means for supporting a cane. As seen in FIGS. 1, 2 and 4 a hole 54 is present in front section 48 of tray-seat 30. A broom clip 56 is mounted to the upper edge of a rear section 58 of the tray-seat as shown in FIGS. 2 and 6. A cane 60 is inserted into the split opening of the broom clip 56 and through hole 54 to securely retain the cane while not in use. The hole 54 also serves as a drain for the tray-seat in the event a spill occurs or the like and liquid collects in the bottom of the tray-seat.

As illustrated in FIGS. 2 and 5 a triangular platform 62 is provided over a portion of the front section 48 and right side section 64 of the tray-seat 30 which has a hole 66 serving as a beverage holder which can stably retain water bottles, soda cans and the like and as a drain. Right side section 64 has a stepped portion 74 and the front side section 48 is elevated above the rear section 58 to support platform 62 above the tray-seat 30.

Figure 7:
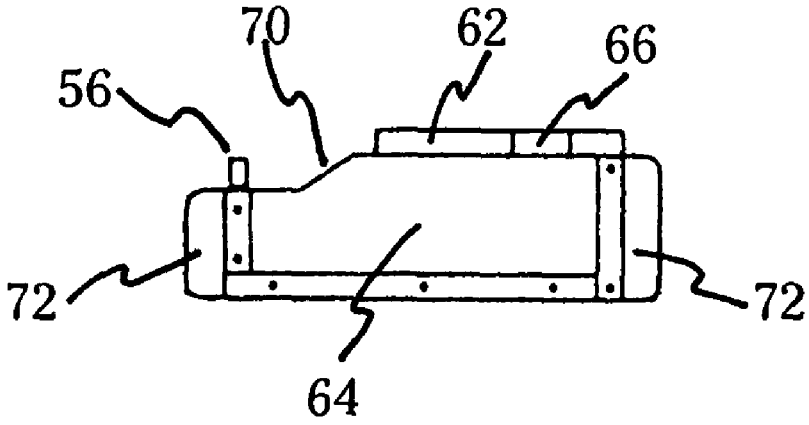
FIG. 7 is a right side plan view of the tray-seat.

As shown in FIG. 2 left side 70 is generally rectangular. As seen in FIG. 7 right side 64 is generally trapezoidal with the ends 72 being generally parallel. The upper portion of the right side 64 has a stepped portion 74 which serves as a base for triangular platform 62. For that purpose front section 48 is raised above the height of rear section 58.

It is clear that the multipurpose combined, removable tray-seat can be readily adapted to fit various types of walkers, including the INVACARE® dual release walkers. The tray-seat is readily detached and easily mounted for use by impaired persons, such as those who have suffered a stroke or the like.

Although the present invention has been described with reference to certain preferred embodiments it is apparent that modifications and variations thereof may be made which will be obvious to those skilled in the art without departing from the scope of the invention as defined in the following claims.

What is claimed is:

1. A walker comprising:

(a) a frame having (i) a pair of inverted U-shaped frame members each having a pair of legs extending downwardly; (ii) a front crossbar affixed to said U-shaped frame members and disposed therebetween to maintain said frame members in an upright position; and (iii) a pair of side braces, each brace extending between the legs of each said U-shaped members; wherein the side braces terminate at each end in a clip for mounting the braces on the legs of the U-shaped members at a predetermined position; and (b) a combined tray-seat detachably mounted on said pair of side braces, said combined tray-seat being generally drawer-shaped and having a base, a front wall, a rear wall and a pair of side wall members, each side wall member extending past the front and rear walls and past the periphery of the frame members and beyond the ends of the side braces to restrain the combined tray-seat against side-to-side and front-to-back movement when the tray is disposed on the braces in a horizontal position, wherein a self-adhering strap is mounted to the front cross bar and a separate complementary self-adhering strip is mounted on the front wall of the combined tray-seat, said strip and said strap formed of a self-adhering material to removably fasten to each other to retain the combined tray-seat in a vertical position when the walker is moved, wherein the combined tray-seat has a hole in the front wall aligned with a broom clip mounted on the top of the rear wall of the combined tray-seat to a support a cane passing through the broom clip and the hole, wherein a perforated platform is affixed on the top of the front wall and the top of one side wall member over a front corner of the combined tray-seat to accommodate a cup or bottle, and wherein the front wall and a portion of the side wall member of the combined tray-seat are raised in height from the rear wall and the other side wall member to support the perforated platform.

* * * * *